US006920306B2

(12) United States Patent
Sato et al.

(10) Patent No.: US 6,920,306 B2
(45) Date of Patent: Jul. 19, 2005

(54) EXTRANEOUS MATTER REMOVAL METHOD AND IMAGE RECORDING EQUIPMENT WITH EXTRANEOUS MATTER REMOVAL FEATURE

(75) Inventors: Hironobu Sato, Fujinomiya (JP); Yoshiharu Sasaki, Fujinomiya (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/459,566

(22) Filed: Jun. 12, 2003

(65) Prior Publication Data

US 2003/0231913 A1 Dec. 18, 2003

(30) Foreign Application Priority Data

Jun. 12, 2002 (JP) ..... 2002-171405

(51) Int. Cl.[7] ..... G03G 21/00; G03G 15/00; B41M 1/14

(52) U.S. Cl. ..... 399/390; 399/99; 399/57; 399/388; 399/98; 101/171; 101/211; 101/425

(58) Field of Search ..... 399/98, 99, 388, 399/390, 57; 101/171, 211, 425; 118/DIG. 15, 45, 677; 15/23, 3

(56) References Cited

U.S. PATENT DOCUMENTS

| | | | | | |
|---|---|---|---|---|---|
| 4,273,438 | A | * | 6/1981 | Nishikawa | 399/139 |
| 4,277,164 | A | * | 7/1981 | Fortmann | 399/165 |
| 4,799,071 | A | * | 1/1989 | Zeise et al. | 347/233 |
| 5,349,714 | A | * | 9/1994 | Korbonski et al. | 15/3 |
| 6,200,392 | B1 | * | 3/2001 | Korbonski | 134/9 |
| 6,237,176 | B1 | * | 5/2001 | Egoshi et al. | 15/3 |
| 6,244,179 | B1 | * | 6/2001 | Sasaki | 101/401.1 |
| 6,283,027 | B1 | * | 9/2001 | Vrotacoe et al. | 101/376 |
| 6,571,706 | B1 | * | 6/2003 | Conzelmann et al. | 101/425 |
| 6,579,655 | B1 | * | 6/2003 | Shimomura et al. | 430/200 |

* cited by examiner

*Primary Examiner*—Ren Yan
*Assistant Examiner*—Marvin P. Crenshaw
(74) *Attorney, Agent, or Firm*—Young & Thompson

(57) ABSTRACT

An image recording equipment is provided with an adhesive roller that is brought into contact with a surface of an image recording sheet wound around a rotary drum and keeps in contact with the image recording sheet with contact pressure axially distributed in a range from approximately 0.01 Mpa to approximately 0.2 Mpa desirably in a concave distribution pattern.

6 Claims, 9 Drawing Sheets

*Fig. 5*

TABLE I

| | Adhesion (hpa) | Pressure Range (Mpa) | Pressure Distribution | Separation | Extraneous Matter Removal | Wrinkle |
|---|---|---|---|---|---|---|
| Practical Example I | 13 | 0.07 - 0.19 | — | ○ | ○ | ○ |
| Practical Example II | 27 | 0.018 - 0.045 | — | ○ | ○ | ○ |
| Practical Example III | 27 | 0.028 - 0.042 | Concave | ○ | ○ | ○ |
| Comparative Example I | 13 | 0.1 - 0.22 | — | × | — | — |
| Comparative Example II | 27 | 0.035 - 0.103 | — | × | — | — |
| Comparative Example III | 27 | 0.041 - 0.05 | Convex | — | — | × |
| Comparative Example IV | 27 | 0 - 0.021 | — | ○ | × | ○ |

EXTRANEOUS MATTER REMOVAL METHOD AND IMAGE RECORDING EQUIPMENT WITH EXTRANEOUS MATTER REMOVAL FEATURE

BACKGROUND OF THE INVENTION

1. Field of the Invention

The present invention relates to an image recording equipment which records an image of written and/or pictorial information on a sheet of recording medium y laser exposure after removal of extraneous matter from the sheet of recording medium with an adhesive roller and a method of removing extraneous matter from the sheet of recording medium and, more particularly, to an adhesive roller that removes extraneous matter from the sheet of recording medium without causing separation of a sheet of recording medium from a rotary drum and/or winkles of the sheet of recording medium.

2. Description of Related Art

There are various recording equipments that record images of written and/or pictorial information such as a written document and a picture on sheets of recording medium (which is hereafter referred to as a recording sheets) by means of, for example, laser exposure. Such a recording equipment is generally made up of an image recording device, a sheet feeding device and a sheet carrying device. The image recording device operates to record images of written and/or pictorial information on recording sheets fed one by one from the feeding device and carried by the carrying device by means of, for example, laser exposure.

Referring to FIG. 9 that shows a fundamental configuration of one of image recording devices of this type, a image recording device includes a hollow cylindrical rotary drum 12 supported for rotation by a frame 14 and a recording head 16 supported for linear movement in a direction in parallel with a rotational axis of the rotary drum 12 on a pair of parallel guide rods 18. The recording head 16 scans a recording sheet (an image recording sheet or an image forming sheet) 1 closely contacted onto the rotary drum 12 by means of suction with a laser beam Lb. The rotary drum 12 is connected to and driven by an output shaft of a motor (not shown). Scanning operation of the recording head 16 is controlled by a control unit (not shown) according to data or scan signals provided for a given original. Further, synchronous operation of the image recording device including the rotary drum 12 and the recording head 16 is controlled by the control unit. As is well known in the art, the image recording device performs image formation through scamming a sheet wound around the rotary drum 12 in a primary scan direction that is the direction of rotation of the rotary drum 12 and a secondary scan direction that is the direction in parallel with the rotational axis of the rotary drum 12.

Although the sheet feeding device and the sheet carrying device which are not of direct importance to the invention are not shown in FIG. 1 because they are known in various forms and may take any form well known to those in the art, a brief description regarding them is hereafter provided for the purpose of enhancing an understanding of the invention. The sheet feeding device includes a sheet feeder tray or cassette in which a number of recording sheets are received, a pickup roller operative to pick up and push the recording sheets out of the sheet feeder cassette one by one to the sheet carrying device. The sheet carrying device, that is disposed between the sheet feeding device and the image recording device, carries the recording sheets one by one onto the recording drum 12 of the image recording device.

The recording sheet for image formation made through steps described below is prepared in a unit of, for example, five-recording sheets.

Referring to FIG. 10, one unit of recording sheets (recording sheet unit) 1 is made up of an image receiving sheet (one of recording sheets) 2 and four mono-color image forming sheets (another one of recording sheets) 3 prepared for four different colors, i.e. black (K), cyan (C), magenta (M) and yellow (Y), respectively. The image receiving sheet 2 comprises a sheet base 2*a*, a cushion layer 2*b* formed over the sheet base 2*a* and an image receiving layer 2*c* formed over the cushion layer 2*b*. The sheet base 2*a* may be made of a polyethylene terephthalate (PET)-based sheet, a triacetylcellulose (TAC)-based sheet, a polyethylene naphthalate (PEN)-based sheet, etc. The image receiving layer 2*c* receives an exposed portion of a pigment layer (which will be described later) of the mono-color image forming sheet 3. The cushion layer 2*b* functions to absorb differences in thickness of a stratified portion of pigment layers transferred onto the image receiving layer 2*c*. The image receiving sheet 2 is fed face-up to and is wound around the rotary drum 12 with the sheet base 2*a* closely contacted to the rotary drum 12.

The mono-color image forming sheet 3 comprises a sheet base 3*a*, a photothermal conversion layer 3*b* formed over the sheet base 3*a*, and a pigment layer 3*c* formed over the photothermal conversion layer 3*b*. The sheet base 3*a* is laser transmssive and may be made of the same material as the sheet base 2*a* of the image receiving sheet 2. The photothermal conversion layer 3*b* functions to convert radiant energy of laser light impinging thereon into thermal energy and may be of a general type of photothermal conversion material such as carbon, black materials, infrared absorption dyes and pigments, or materials that absorb light of specific wavelengths. The mono-color image forming sheet 3 is prepared for each of the different colors, black (K), cyan (C), magenta (M) and yellow (Y). When needed, the mono-color image forming sheet 3 is prepared for each of what are called special colors, such as gold and silver.

In the case where exposure for the formation of color image is achieved by forming four mono-color images in order of black (K), cyan (C), magenta (M) and yellow (Y), the recording sheet unit 1 includes the image receiving sheet 2, the black image forming sheet 3(K), the cyan image forming sheet 3(C), the magenta image forming sheet 3(M) and the yellow image forming sheet 3(Y) stacked in this order as one unit. In each recording sheet unit 1, the image receiving sheet 2 is put face-up and all the mono-color image forming sheets 3 are put face-down in the stack. A number of the recording sheet units 1 are received and stacked in the sheet feeder cassette. When recording an image on the recording sheet unit 1, the image receiving sheet 2 of an uppermost recording sheet unit 1 is fed to the image recording device at the first setout, and then the black, cyan, magenta and yellow image forming sheets 3(K), 3(C), 3(M) and 3(Y) of the uppermost recording sheet unit 1 are fed to the image recording device one by one in this order for sequential exposure. The same sheet feeding procedure is repeated for the following recording sheet units 1. The recording sheet unit 1 is known in various forms as disclosed in, for example, Japanese Unexamined Patent Publication Nos. 4-296594, 4-327982 and 4-327983 and may take any form well known to those in the art.

Recording a color image on the recording sheet unit 1 is performed the subtractive color process through four steps schematically shown in FIG. 11. Specifically, a color original, such as a written document or a color picture, to be reproduced is separated into three primary color images, i.e. cyan(C), magenta (M) and yellow (Y) images, in a well known manner.

After setting at least one recording sheet unit 1 in the sheet feeder cassette, the image receiving sheet 2 of the uppermost recording sheet unit 1 is picked up by the sheet feeding device and, then, carried face-up to the image recording device through the carrying device. The image receiving sheet 2 is wound around the rotary drum 12 with the sheet base 2*a* closely contacted to the rotary drum 12 by means of suction (Step I). Subsequently, the black image forming sheet 3(K) having a black pigment layer 3*c* of the uppermost recording sheet unit 1 is picked up by the sheet feeding device and, then, carried face-down to the image recording device through the sheet carrying device so as to be laid over the image receiving sheet 2 (Step II). In this state, the rotary drum 12 and the recording head 16 are driven in synchrinization in the primary and secondary scan directions according to data or scan signals provided for a given original to scan the black image forming sheet 3(K) with a laser beam Lb (Step III). As a result of the scan, the photothermal conversion layer 3*b* of the black image forming sheet 3(K) converts radiant energy of the laser beam into thermal energy in a distribution pattern in conformity with a black image of the given original. When peeling away the black image forming sheet 3(K) from the image receiving sheet 2 at the completion of scan, the black pigment layer 3*c* configured in the thermal energy distribution pattern is transferred to the image receiving sheet 2 (Step IV). As a result, a black image K of the given original is formed on the image receiving sheet 2.

These steps I to IV are repeated for the respective primary colors, i.e. cyan (C), magenta (M) and yellow (Y). As a result, the black, cyan, magenta and yellow images K, C, M and Y of the given original are formed on top of one another in this order on the image receiving sheet 2 and, in consequence, a color image of the given original is recorded on the image receiving sheet 2. The image receiving sheet 2 is peeled away from the rotary drum 12 at the completion of transfer of the black, cyan, magenta and yellow images K, C, M and Y. Thereafter, the image receiving sheet 2 is further processed in an image transfer processing device (not shown) to transfer the color image formed thereon onto a printing paper. In this way, a color image of the given original is reproduced on the printing paper.

During performing the process, it is possibly expected that solid foreign matter adheres to the surfaces of the image receiving sheet 2 and/or mono-color image forming sheets 3. As shown in FIG. 12 by way of example, if there is extraneous solid matter X such as dust or a particle between top layers 2*c* and 3*c* of the image receiving and mono-color image forming sheets 2 and 3, respectively, placed on top of each other, a void G occurs between them and, in consequence, causes the mono-color image forming sheet 3 to make a local convex deformation. The occurrence of void G is causative of an image defect such as a white or blank spot of an extent SI in an image formed on the image receiving sheet 2, and hence, of an image reproduced on a printing paper.

In light of these circumstances, studies are being made on how to prevent an occurrence of an image defect due to extraneous matter between these image receiving and image forming sheets 2 and 3. One of some solutions is the use of an adhesive roller operative functioning to remove extraneous matter from the image receiving sheet 2 and/or the mono-color image forming sheet 3 with adhesion at a location where at least one of sheet feeding device, the sheer carrying device and the image recording device is stationed. The adhesive roller is brought into contact with the image receiving layer 2*c* of the image receiving sheet 2 and the pigment layer 3*c* of the mono-color image forming sheet 3 during movement of them, or with the image receiving layer 2*c* of the image receiving sheet 2 wound around the rotary drum 12 of the image recording device.

In the case where the adhesive roller is installed to the image recording device so as to be brought into contact with the image receiving layer 2*c* of the image receiving sheet 2 wound around the rotary drum 12, if the adhesive roller is forced against the image receiving sheet 2 with a comparatively low contact pressure, it is difficult for the adhesive roller to remove extraneous matter of the image receiving layer 2*c* of the image receiving sheet 2. On the other hand, if the adhesive roller is forced against the image receiving sheet 2 with a contact pressure that is too high, the adhesive roller possibly breaks away the functional layer, i.e. the image receiving layer 2*c* and, in some cases, the cushion layer 2*b* from the sheet base 2*a* of the image receiving sheet 2, or possibly removes the image receiving sheet 2 itself from the rotary drum 12 against the suction when the adhesive roller is drawn apart from the image receiving sheet 2. Furthermore, in the case where the adhesive roller is installed in the path of movement of the sheets so as to establish contact with the image receiving layer 2*c* of the image receiving sheet 2 or the pigment layer 3*c* of the mono-color image forming sheet 3, the sheets are possibly wrinkled or undulated. In this instance, the image receiving sheet 2 often fails to wind itself closely around the rotary drum 12 due to wrinkles or undulation, and the wrinkled mono-color image forming sheet 3 fails to lay closely over the image receiving sheet 2 on the rotary drum 12 due to wrinkles or undulation.

SUMMARY OF THE INVENTION

It is therefore an object of the present invention to provide an image recording equipment with extraneous matter removing means for removing extraneous matter leading to an occurrence of image defects from a functional layer forming a part of an image receiving sheet or a mono-color image forming sheet.

It is another object of the present invention to provide an image recording equipment with extraneous matter removing means for removing extraneous matter from a functional layer forming a part of an image receiving sheet or a mono-color image forming sheet which prevents related accidental separation of the functional layer.

It is still another object of the present invention to provide an image recording equipment with extraneous matter removing means for removing extraneous matter from a functional layer forming a part of an image receiving sheet or an image forming sheet which prevents the sheet from causing wrinkles and/or undulation during movement of the sheet.

The aforesaid objects of the present invention are achieved by an image recording equipment for recording images of given originals such as written document and pictorial information on recording sheets that comprises image recording means for recording an image on the recording sheet by means of laser exposure, sheet feeding means for feeding the recording sheets face-up one by one toward the image recording means, sheet carrying means disposed between the image recording means and the sheet feeding means for carrying the recording sheets one by one to the image recording means from the sheet feeding means, and an adhesive roller incorporated in one of the image recording means, the sheet feeding means and the sheet carrying means. The adhesive roller is brought into contact with an upper surface or functional layer of the recording sheet moving to the one of the image recording means, the sheet feeding means and the sheet carrying means and removes extraneous matter from the surface of the recording sheet during movement of the recording sheet. The adhesive roller keeps in contact with the sheet with a contact pressure axially distributed in a range from approximately 0.01 Mpa to approximately 0.2 Mpa, and more desirably in a range from approximately 0.01 Mpa to approximately 0.05 Mpa.

The contact pressure is desirably distributed in a concave distribution pattern in an axial direction of the adhesive roller, in other words, the contact pressure is desirably higher at opposite extreme end positions thereof than at a middle position thereof.

According to another aspect of the present invention, a method of removing extraneous matter from the recording sheets on which images of given originals, such as written documents or pictorial information, are recorded respectively using an image recording equipment that comprises image recording means for recording an image on the recording sheet by means of laser exposure, sheet feeding means for feeding the recording sheets one by one toward the recording means, sheet carrying means disposed between the recording means and the sheet feeding means for carrying the recording sheet picked up from the sheet feeding means to the recording means, and an adhesive roller incorporated in one of the image recording means, the sheet feeding means and the sheet carrying means.

Removal of extraneous matter on the recording sheet is performed by bringing the adhesive roller into contact with a surface of the recording sheet moving to the one of image recording means, the sheet feeding means and the sheet carrying means with contact pressure axially distributed in a range from approximately 0.01 Mpa to approximately 0.2 Mpa, and more desirably in a range from approximately 0.01 Mpa to approximately 0.05 Mpa, and causing relative rotation between the adhesive roller and the recording sheet.

In the extraneous matter removal method, the contact pressure is desirably distributed in a concave distribution pattern in an axial direction of the adhesive roller, in other words, the contact pressure is desirably higher at opposite extreme end positions thereof than at a middle position thereof.

With the image recording equipment in which the adhesive roller keeps in contact with the recording sheet wound around a rotary drum of the image recording means with contact pressure distributed in a suitable range established for extraneous matter removal, the adhesive roller is prevented from leaving extraneous matter partly unremoved from the recording sheet due to excessively low contact pressure and causing separation of a recording sheet from the rotary drum and/or flaking of the functional layer of the recording sheet due to excessively high contact pressure. Furthermore, as the adhesive roller keeps in contact with the recording sheet wound around a rotary drum of the image recording means with contact pressure distributed in a concave axial distribution pattern, the adhesive roller that is disposed in the path of movement of the recording sheet between the recording means and the sheet feeding means keeps itself in contact with the recording sheet firmly at opposite extreme ends, so as to prevent the recording sheet from causing slack. As a result, the recording sheet is prevented from producing wrinkles or undulation and, in consequence, stable extraneous matter removal with the adhesive roller is realized because of free of wrinkles and/or undulation of the recording sheet.

BRIEF DESCRIPTION OF THE DRAWINGS

The above and other objects and features of the present invention will be clearly understood from the following detailed description when read with reference to the accompanying drawings, in which:

FIG. 5 is a table of results of extraneous matter removal capability tests of the adhesive roller with respect to contact pressure in different axial distribution patterns of the adhesive roller against a recording sheet;

DETAILED DESCRIPTION OF THE PREFERRED EMBODIMENTS

Figure 9:
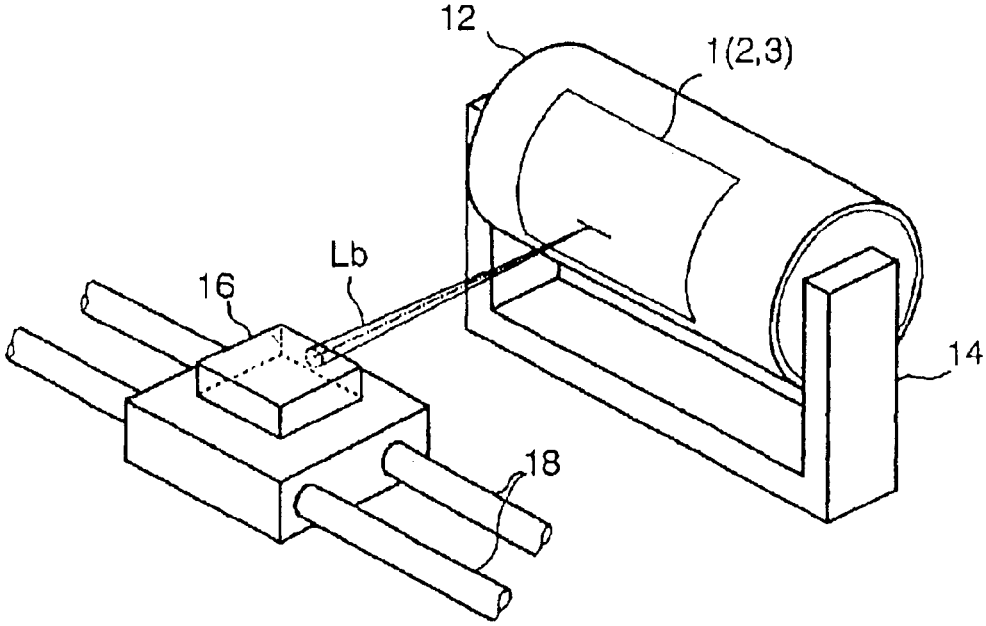
FIG. 9 is a schematic perspective view of an image recording device incorporated in the image recording equipment of FIG. 1 or 3.
Figure 10:
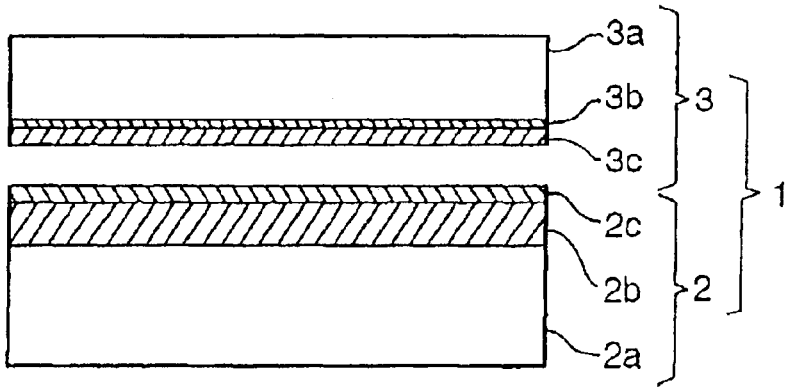
FIG. 10 is a cross-sectional view of a recording sheet comprising an image receiving sheet and one of mono-color image forming sheets.
Figure 11:
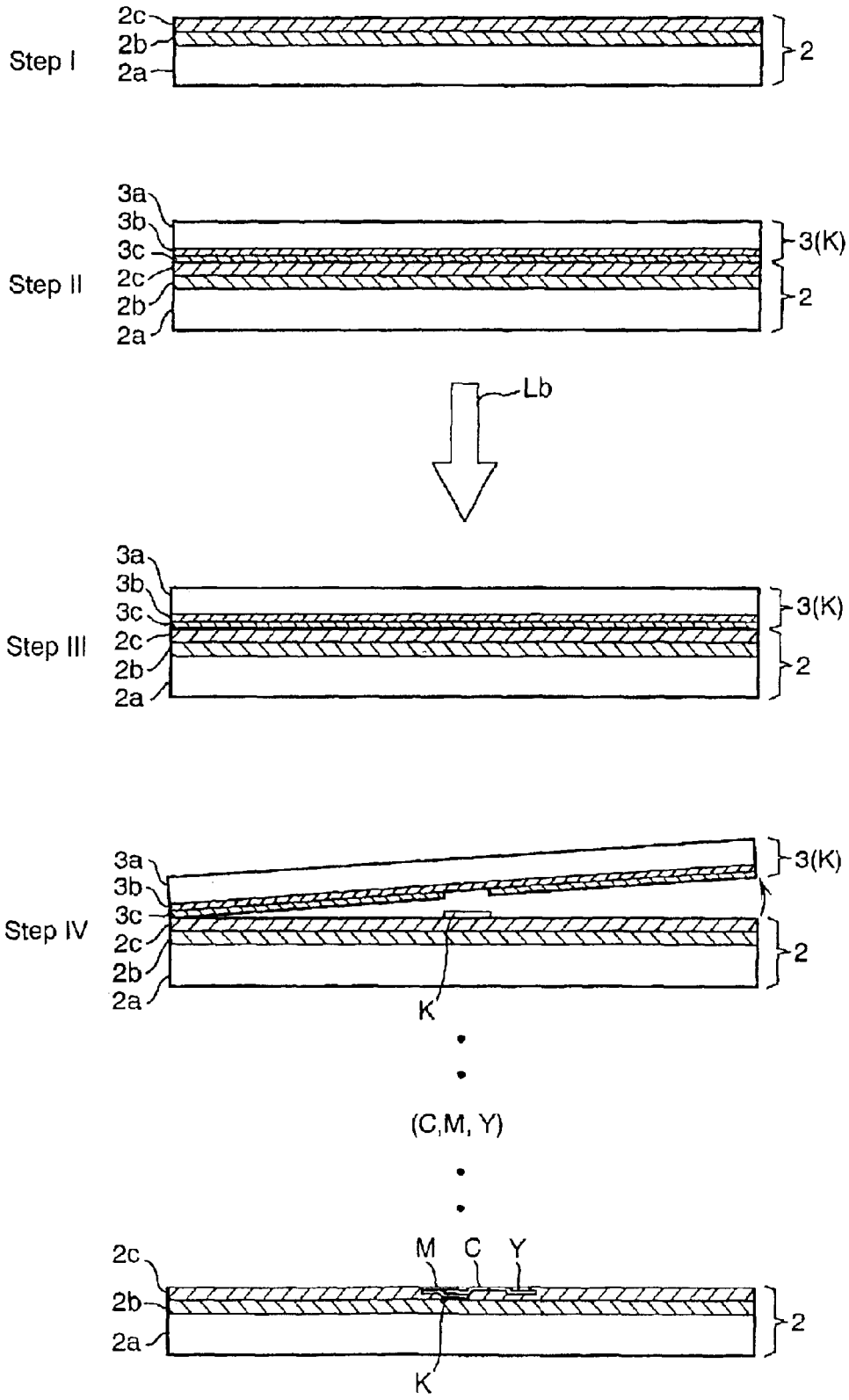
FIG. 11 is an illustration showing a procedure of forming and transforming a color image on the image receiving sheet.
Figure 12:
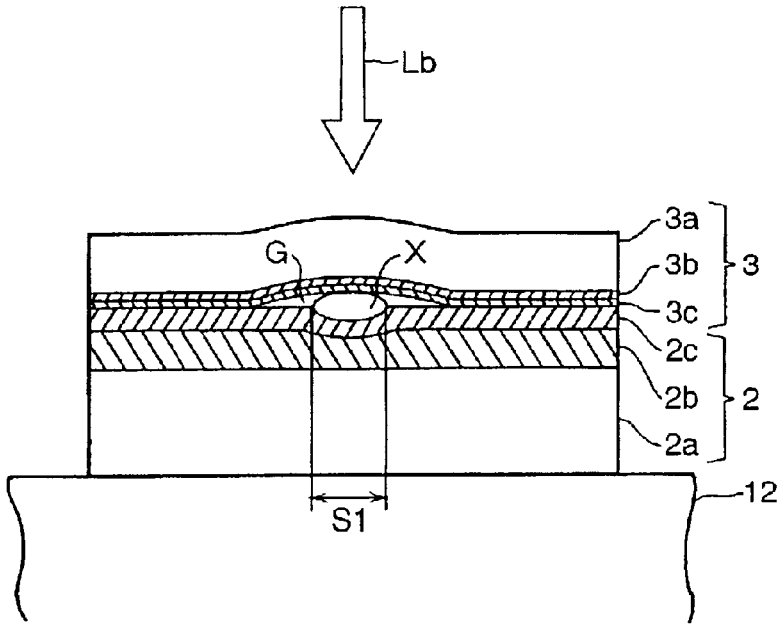
FIG. 12 is an explanatory cross-sectional view of an image receiving sheet and one of mono-color image forming sheets with a foreign particle entrained therebetween.

Referring to the accompanying drawings in detail, and particularly to FIG. I showing an image recording equipment 100 for use with the recording sheet unit 1 shown in FIG. 10 according to an embodiment of the present invention, the image recording device 10 comprises a rotary drum 12 for holding an image receiving sheet 3 by suction, a recording head 16 for scanning an image receiving sheet 3 wound around the rotary drum 12 with a laser beam and a control unit 17 for performing synchronous operation of the rotary drum 12 and the recording head 16 such as shown in FIG. 9 and a roller drive mechanism 50 including an adhesive roller 51 and a roller actuator 52.

The control unit 17 performs scan by controlling rotation of the rotary drum 12 in the primary direction and linear movement of the recording head 12 in the secondary scan direction. A sheet feeding device 20 includes a sheet feeder tray or cassette 23 and a pick-up roller 22. The sheet cassette 23 contains a number of recording sheet units 1. As was previously described, the recording sheet unit 1 is in sets of five sheets including an image receiving sheet 2 and black, cyan, magenta and yellow image forming sheets 3 stacked in this order. The pick-up roller 22 picks up and pulls out the sheets from the sheet cassette 23 one by one. The sheet, i.e. the image receiving sheet 2 or the mono-color image forming sheet 3, is carried to the rotary drum 12 by a sheet carrying device (not shown) and wound around the rotary drum 12.

In this instance, the image recording device 10 is provided with the roller drive mechanism 50 including the adhesive roller 51 and the roller actuator 52. The roller drive 52 has an air piston 53 pneumatically controlled to move down the adhesive roller 51 at a specified timing to bring it into contact with the sheet 2 or 3 wound around the rotary drum 12. While the adhesive roller 51 is kept in contact with the sheet 2 or 3, the adhesive roller 51 rotates following the rotary drum 12. If the sheet 2 or 3 has extraneous matter on the top surface thereof, the adhesive roller 51 adhesively removes the extraneous matter from the sheet 2 or 3.

The adhesive roller 51 is laminated with an adhesive material such as an adhesive rubber. It is preferred to employ an adhesive rubber containing titanium oxide (TiOx) and/or a hydrocarbon compound having a functional group such as C—O or i-O and, however, not containing barium (Ba). The adhesive roller 51 laminated with this kind of adhesive rubber is hard to cause deterioration with age and maintains its extraneous matter removal performance for a long period of time., in this embodiment, Practically recommendable adhesive rubber is, for example, "Carbonless MIMOSA" with grade "LT" or "ST" that is distributed by Miyagawa Rubber Co., Ltd.

The inventors of this application have conducted a large number of experiments on how the functional layer separates from the sheet, how the sheet is removed from the rotary drum 12, and how the sheet wrinkles when the adhesive roller 51 removes extraneous matter attached to the sheet being kept in contact with the sheet. As a result of careful consideration to data obtained from the experiments, it was determined that these troubles occur resulting from excess or deficiency and/or non-sequitur distribution of contact pressure between the adhesive roller 51 and the rotary drum 12.

In consideration of the finding, it was revealed that the most realistic and effective solution was to control contact pressure between the adhesive roller 51 and a sheet wound around the rotary drum 12 so as to be distributed in a range from approximately 0.01 Mpa to approximately 0.2 Mpa in a concave axial distribution pattern. That is, the adhesive roller 51 keeps in contact with a sheet wound around the rotary drum 12 with a contact pressure higher at its opposite ends than in its central region (the highest pressure is 0.2 Mpa at each end and the lowest pressure is 0.01 Mpa in a central region). This pattern of contact pressure distribution is hereafter referred to as a concave axial distribution pattern. The contact pressure and its axial distribution are practically adjusted through control of the roller actuator 52 and the surface form and size of the adhesive roller 51 and/or the surface form and size of the rotary drum 12.

Figure 2:
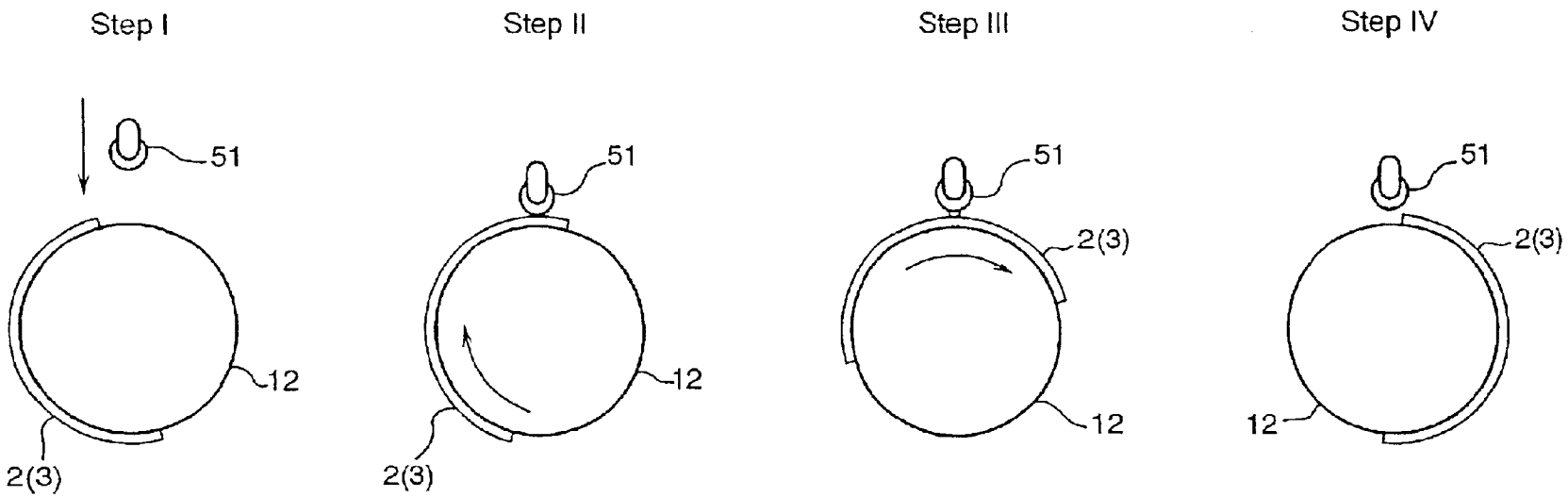
FIG. 2 is an illustration showing a procedure of extraneous matter removal with an adhesive roller.

Practically, removal of extraneous matter is performed through steps (1)–(IV) process shown in FIG. 2. After the image receiving sheet 2 has been wound around the rotary drum 12 (Step I), the roller drive mechanism 50 causes the roller actuator 52 to lower the adhesive roller 51 so as thereby to bring the adhesive roller 51 into contact with the image receiving sheet 2 with a specified contact pressure (Step II). Subsequently, the adhesive roller 51 is moved relatively to the image receiving sheet 2 from one of opposite ends of the sheet 2 toward another end by rotating the rotary drum 12 keeping itself in contact with the sheet 2 (Step III). When the adhesive roller 51 reaches the other end of the sheet 2, the roller drive mechanism 51 causes the roller actuator 52 to lift back the adhesive roller 51 to complete removal of extraneous matter from the sheet 2 (Step IV). These steps (I)–(IV) are applied to the mono-color image forming sheet 3 substantially likely to the image receiving sheet 3.

Figure 1:
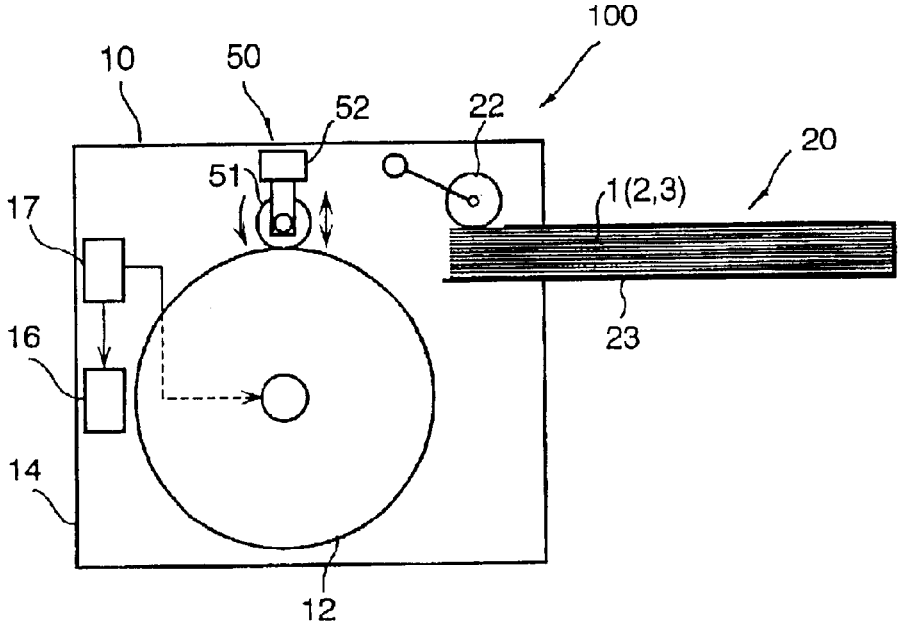
FIG. 1 is a schematic view of essential part of an image recording equipment according to a preferred embodiment of the present invention.
Figure 3:
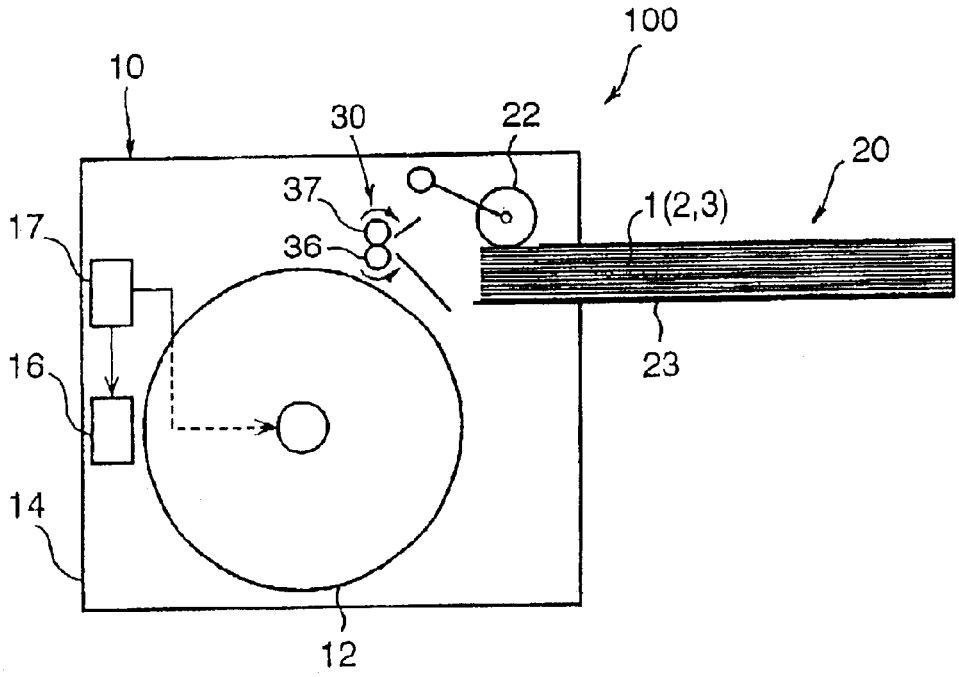
FIG. 3 is a schematic view, similar to FIG. 3, of essential part of an image recording equipment according to alternative preferred embodiment of the present invention.
Figure 4:
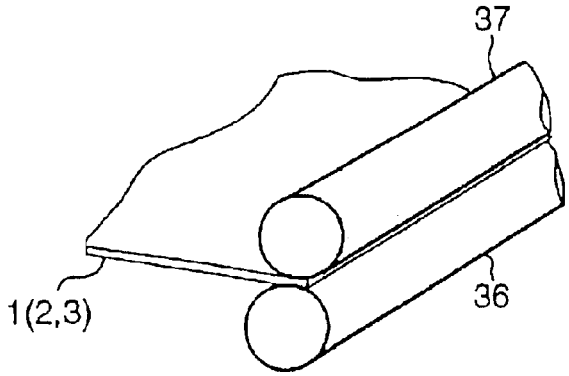
FIG. 4 is a perspective view of a conformation of an adhesive roller and a carrying roller at a sheet carrying device.

FIG. 3 shows an image recording equipment 300 for use with the recording sheet unit 1 shown in FIG. 10 according to an alternative embodiment of the present invention, an image recording device 10 comprises a rotary drum 12 for holding an image receiving sheet 3 by suction, a recording head 16 for scanning an image receiving sheet 3 wound around the rotary drum 12 with a laser beam and a control unit 17 for performing synchronous operation of the rotary drum 12 and the recording head 16 all of which are the same in structure and operation as those of the image recording device of the previous embodiment shown in FIG. 1. The image recording device 10 includes therein a sheet carrying device 30 which will be described later.

A sheet feeding device 20 includes a sheet cassette 23 and a pick-up roller 22. The sheet cassette 23 contains a number of recording sheet units 1 in sets of five sheets including an image receiving sheet 2 and black, cyan, magenta and yellow image forming sheets 3 stacked in this order. The pick-up roller 22 picks up and pulls out the sheets from the sheet cassette 23 one by one. The sheet, i.e. the image receiving sheet 2 or the mono-color image forming sheet 3, is carried to the rotary drum 12 by a sheet carrying device (not shown) and wound around the rotary drum 12.

The sheet carrying device 30 comprises upper and lower rollers, namely an adhesive roller 37 and a carrying roller 36 arranged side by side which are common to transportation and extraneous matter removal of the image receiving sheets 2. Specifically, the adhesive roller 37 is similar in structure and operation to or the same in structure and operation as the adhesive roller 51 described in connection with the previous embodiment. The carrying roller 36 is one that is widely employed for general use. The sheet 2 pulled out from the cassette 23 by the pickup roller 22 and guided by upper and lower guide plates 38 is nipped with and then carried by the adhesive and carrying rollers 37 and 36. As the sheet 2 is pushed ahead to the rotary drum 12 with the adhesive and carrying rollers 37 and 36, the sheet 2 is wound around the rotary drum 12 by means of suction. The adhesive and carrying rollers 37 and carrying roller 36 are forced against each other by pressure means (not shown) so as to nip the sheet 2 therebetween with a specified contact pressure in the same axial distribution pattern as that described in connection with the previous embodiment and driven by drive means (not shown) so as to transfer the sheet 2 to he rotary drum 12.

In order to verify the function and effect of the present invention, the inventors of this application have conducted a large number of experiments on the extraneous matter removal performance of the adhesive roller, the presence of wrinkles of a sheet arising from the adhesive roller, and a contact pressure and its axial distribution pattern produced by the adhesive roller. Various sample rollers were prepared as practical examples I and II according to the present invention and comparative examples I, II, III and IV. The sample rollers of the practical examples I and II and the comparative examples I, II and IV were tested using the image recording equipment 100 shown in FIG. 1. The sample rollers of the comparative examples I and II were configured to produce a contact pressure that was axially distributed in a concave axial distribution pattern but in a range defined by upper and lower extreme values excessively higher than those of the range established for the adhesive rollers of each practical example of the present invention, respectively, and the sample roller of the comparative example IV was configured to produce a contact pressure that was axially distributed in a concave axial distribution pattern but in a range having a median value was excessively lower than that of the range established for the adhesive roller of each practical example of the present invention. On the other hand, the sample roller of the comparative example III was configured to produce a contact pressure in a concave axial distribution pattern in which a median value is higher than upper and lower extreme values. Further, the sample rollers of the practical example I and the comparative example I had adhesion of 13 hpa, and the sample rollers of the remaining examples had adhesion of 27 hpa.

Visual evaluation of the test results revealed that the adhesive roller of each practical example configured according to the present invention was favorably acceptable for the image recording equipment. Specifically, as shown in Table I in FIG. 5, the adhesive rollers of the practical examples I, II and III showed satisfactory extraneous matter removal performance and did not cause separation of a sheet from the rotary drum 12 and nor wrinkles of the sheet at all. However, the adhesive roller of the comparative example IV showed extraneous matter remaining unremoved. Further, the adhesive rollers of the comparative examples I, II and III caused separation of a sheet from the rotary drum 12 or wrinkles of a sheet.

Figure 6:
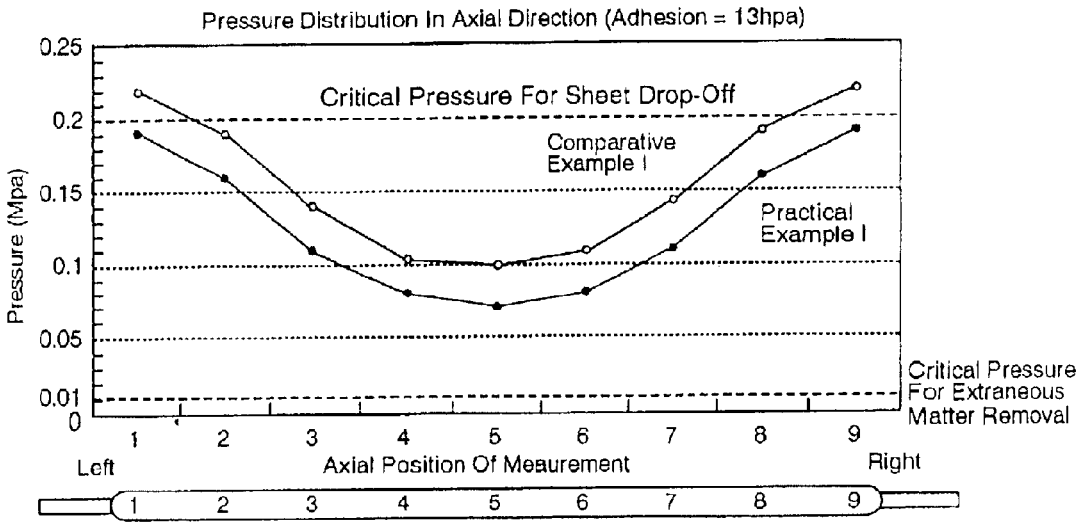
FIG. 6 is a graphical chart showing axial distribution patterns of contact pressure of the adhesive roller against a recording sheet for a practical example I of the present invention and a comparative example I.
Figure 7:
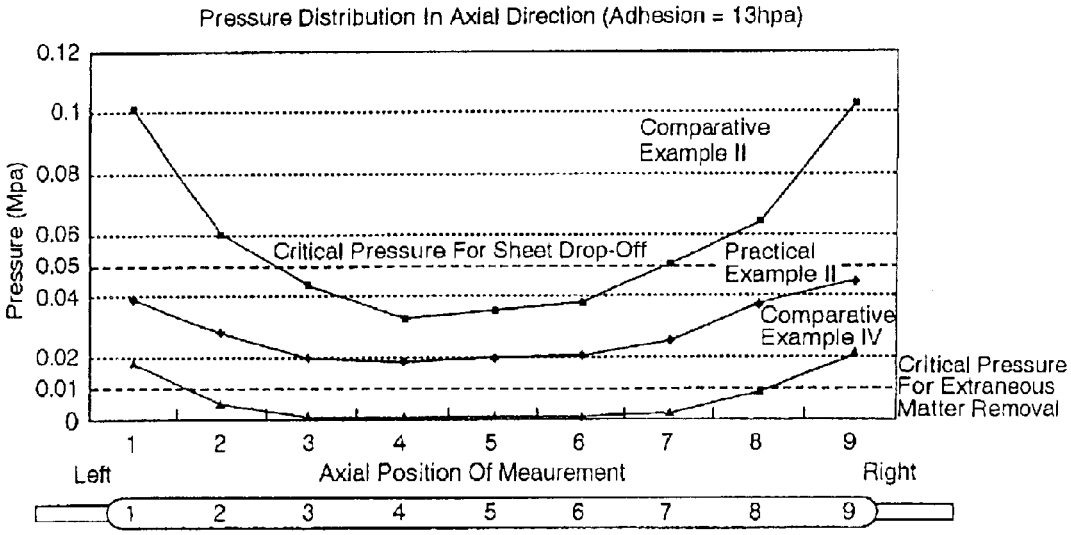
FIG. 7 is a graphical chart showing axial distribution patterns of contact pressure of the adhesive roller against a recording sheet for a practical example II of the present invention and comparative examples II and IV.
Figure 8:
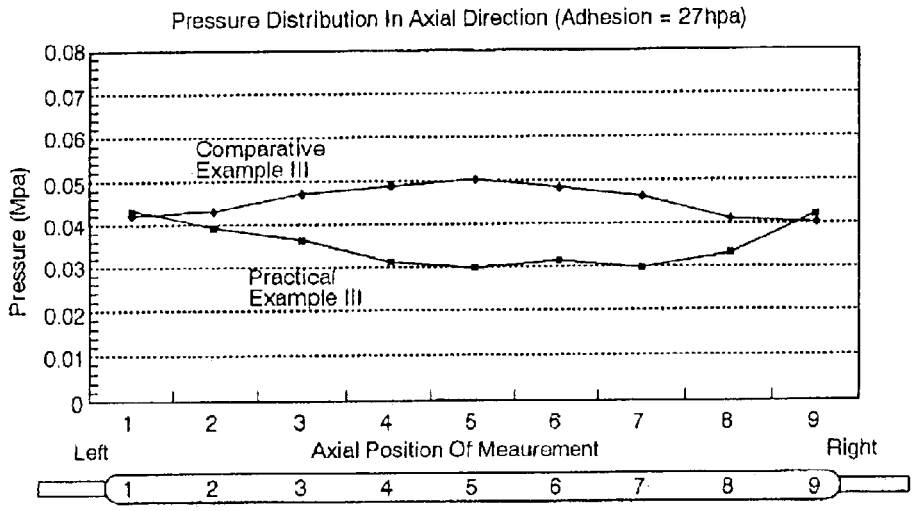
FIG. 8 is a graphical chart showing axial distribution patterns of contact pressure of the adhesive roller against a recording sheet for a practical example III of the present invention and a comparative example III.

FIGS. 6 to 8 show axial distribution patters of contact pressure of the adhesive rollers of the practical examples I to III and the comparative examples I to IV. As demonstrated in FIGS. 6 and 7, the critical contact pressure for satisfactory extraneous matter removal is 0.01 Mpa regardless of adhesion (e.g. 13 hpa and 27 hpa) of the adhesive rollers. However, the critical contact pressure for separation of a sheet is different according to adhesion (e.g. 13 hpa and 27 hpa) of the adhesive rollers and, more specifically, tends to drop to a lower level as the adhesion of the adhesive roller becomes larger. That is, the critical contact pressure for separation of a sheet is 0.2 Mpa when the adhesive roller has adhesion of 13 hpa and 0.05 Mpa when the adhesive roller has adhesion of 27 hpa.

In light of prevention of separation of a sheet from the rotary drum, it is preferred for an adhesive roller having high adhesion to produce contact pressure against a sheet wound around the rotary drum 12 distributed in a range from approximately 0.01 Mpa to approximately 0.05 Mpa in a concave axial distribution pattern.

In the image recording equipment according to the embodiment of the present invention shown in FIG. 1, the adhesive roller 51 may be brought into contact with the rotary drum 12 during rotation of the rotary drum 12 before the image receiving sheet 2 reaches the rotary drum 12 so as thereby to remove extraneous matter on the surface of the rotary drum 12. This prevents the image receiving sheet 2 from making a local convex deformation due to the presence of extraneous matter, in particular a solid foreign particle, which is causative of an image defect in an image formed on the image receiving sheet 2.

In the image recording equipment according to the embodiment of the present invention shown in FIG. 3, the adhesive roller 37 may be additionally provided before or after the carrying roller 37 or in place of the carrying roller 37. Alternatively, the adhesive roller 37 may be additionally provided in place of the pickup roller incorporated in the sheet feeding device.

It is to be understood that, although the present invention has been described with regard to various preferred embodiments thereof, various other embodiments and variants may occur to those skilled in the art, which are within the scope and spirit of the invention, and such other embodiments and variants are intended to be covered by the following claims.

What is claimed is:

1. An image recording equipment for recording an image of information such as written and/or pictorial information on sheets of recording medium, said image recording equipment comprising:

recording means for recording an image on said sheet of recording medium by means of laser exposure;

sheet feeding means for feeding said sheets of recording medium one by one toward said recording means;

sheet carrying means disposed between said recording means and said sheet feeding means for carrying said sheet of recording medium from said sheet feeding means to said recording means; and an adhesive roller incorporated in one of said image recording means, said sheet feeding means and said sheet carrying means so that said adhesive roller is brought into contact with a surface of said sheet of recording medium moving to said one of image recording means, said sheet feeding means and said sheet carrying means so as thereby to remove extraneous matter on said sheet of recording medium;

wherein said adhesive roller keeps in contact with said sheet of recording medium with contact pressure that is axially distributed in a concave axial distribution pattern in which said contact pressure is higher at opposite extreme end positions of said adhesive roller than at a middle position of said adhesive roller.

2. An image recording equipment as defined in claim 1, wherein said contact pressure is axially distributed in a range from approximately 0.01 Mpa to approximately 0.2 Mpa.

3. An image recording equipment as defined in claim 1, wherein said contact pressure is axially distributed in a range from approximately 0.01 Mpa to approximately 0.5 Mpa.

4. A method of removing extraneous matter from a sheet of recording medium on which an image recording equipment records an image of information such as written and/or pictorial information, said image recording equipment comprising recording means for recording an image on said sheet of recording medium by means of laser exposure, sheet feeding means for feeding said sheets of recording medium one by one toward said recording means, sheet carrying means disposed between said recording means and said sheet feeding means for carrying said sheet of recording medium from said sheet feeding means to said recording means, and an adhesive roller incorporated in one of said image recording means, said sheet feeding means and said sheet carrying means, said method comprising the steps of:

bringing said adhesive roller into contact with a surface of said sheet of recording medium moving to said one of image recording means, said sheet feeding means and said sheet carrying means with contact pressure that is axially distributed in a concave axial distribution pattern in which said contact pressure is higher at opposite extreme end positions of said adhesive roller than at a middle position of said adhesive roller; and causing relative rotation between said adhesive roller and said sheet of recording medium.

5. A method of removing extraneous matter as defined in claim 4, wherein said contact pressure is axially distributed in a range from approximately 0.01 Mpa to approximately 0.2 Mpa.

6. A method of removing extraneous matter as defined in claim 4, wherein said contact pressure is axially distributed in a range from approximately 0.01 Mpa to approximately 0.05 Mpa.

* * * * *